US010113715B2

(12) United States Patent
Xue et al.

(10) Patent No.: US 10,113,715 B2
(45) Date of Patent: Oct. 30, 2018

(54) SHEVLE SYSTEM AND LABEL LED STRIP LAMP THEREFOR

(71) Applicants: Self Electronics Co., Ltd., Ningbo (CN); Wanjiong Lin, Ningbo (CN); Self electronics USA Corporation, Norcross, GA (US)

(72) Inventors: Yuanfang Xue, Ningbo (CN); Guoqing Zeng, Ningbo (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/624,159

(22) Filed: Jun. 15, 2017

(65) Prior Publication Data

US 2018/0180261 A1 Jun. 28, 2018

(30) Foreign Application Priority Data

Dec. 22, 2016 (CN) ..... 2016 1 1194910

(51) Int. Cl.

| | |
|---|---|
| ***A47B 23/06*** | (2006.01) |
| ***F21V 17/16*** | (2006.01) |
| ***F21S 4/28*** | (2016.01) |
| ***F21V 3/00*** | (2015.01) |
| ***F21V 19/00*** | (2006.01) |
| ***A47B 96/02*** | (2006.01) |
| ***A47F 5/00*** | (2006.01) |

(Continued)

(52) U.S. Cl.

CPC ..... *F21V 17/16* (2013.01); *A47B 96/027* (2013.01); *A47F 5/0043* (2013.01); *A47F 11/10* (2013.01); *F21S 4/28* (2016.01); *F21V 3/00* (2013.01); *F21V 19/003* (2013.01); *A47B 2220/0077* (2013.01); *F21Y 2103/10* (2016.08); *F21Y 2115/10* (2016.08)

(58) Field of Classification Search

CPC ... F21S 4/20; F21S 4/28; A47F 5/0043; A47F 11/10; F21V 19/001; F21V 19/003; F21V 19/0035; F21V 19/004; F21V 19/0015; A47B 96/06; A47B 2220/0077

See application file for complete search history.

(56) References Cited

U.S. PATENT DOCUMENTS

| | | | | |
|---|---|---|---|---|
| 8,172,096 | B2 * | 5/2012 | Van De Steen ..... | A47B 96/02 211/119.003 |
| 2005/0082450 | A1 * | 4/2005 | Barrett ..... | A47F 5/0068 248/229.16 |

(Continued)

*Primary Examiner* — Thien M Le
*Assistant Examiner* — April Taylor
(74) *Attorney, Agent, or Firm* — Wang Law Firm, Inc.

(57) ABSTRACT

A shelve system and a label LED strip lamp includes a shelve and a label LED strip lamp. Each of at least one carrier element includes a body, and a clamping assembly. The clamping assembly includes a clamping slot and a catch plate provided on the clamping slot. The label LED strip lamp includes a snap assembly for engagement with the catch plate, and a lamp tube. The snap assembly includes a connecting edge, a set of clamping tooth disposed on one side of the connecting edge, and a wavy-shaped engaging edge spaced from the clamping tooth. The clamping tooth inserts into the clamping slot. The lamp tube includes a non-transparent edge, an upper light transmitting edge connecting the non-transparent edge with the catch plate, and a lower light transmitting edge.

12 Claims, 5 Drawing Sheets

(51) Int. Cl.

| | |
|---|---|
| ***A47F 11/10*** | (2006.01) |
| *F21Y 115/10* | (2016.01) |
| *F21Y 103/10* | (2016.01) |

(56) References Cited

U.S. PATENT DOCUMENTS

| | | | | |
|---|---|---|---|---|
| 2008/0285260 | A1* | 11/2008 | Sherman | A47F 5/0043 362/133 |
| 2010/0135020 | A1* | 6/2010 | Moore | A47F 11/10 362/249.02 |
| 2011/0058357 | A1* | 3/2011 | Anderson | A47F 3/001 362/125 |
| 2011/0164407 | A1* | 7/2011 | Stack | A47F 3/001 362/125 |
| 2014/0153279 | A1* | 6/2014 | Weyer | A47F 5/0869 362/604 |
| 2015/0070928 | A1* | 3/2015 | Rau | G09F 13/18 362/604 |

* cited by examiner

SHEVLE SYSTEM AND LABEL LED STRIP LAMP THEREFOR

RELATED APPLICATION

This present application claims benefit of the Chinese Application, CN 201611194910.3, filed on Dec. 22, 2016.

BACKGROUND

1. Technical Field

The present application relates to lighting equipments, and more particularly to a shelve system and a label LED strip lamp therefor.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of strip LED lamps. Moreover, in addition to lighting equipments, such as general traffic lights, billboards, motor-lights, etc., also use light-emitting diodes as light source. As described above, for the light-emitting diodes as a light source, the advantage is power saving, and the greater brightness. Therefore, the use has been gradually common.

With the popularity of LED strip lamps, more and more occasions start using LED strip lamps. For supermarkets, shopping malls, museums, exhibition halls and other places, a lot of shelves will be used, and these shelves include at least shelves rails, angle brackets disposed on the shelves rails, and a plurality of carrier elements arranged on the angle brackets. In actual use, a general shelf system will be set at least three layers of the carrier elements. The lightings between these carrier elements are generally from two sources of light. One is ceiling lighting, such as the top of the supermarkets, shopping malls, museums. The other is lighting which is set in underlying of each layer of the carrier elements. However, when the goods are exhibits on the carrier elements, the display side of the goods cannot always be highlighted. That is to say, the display side of the goods in the nearest row towards the client is the same as the light obtained from the other side. Therefore, it is difficult to enhance the client's desire to buy.

Therefore, it is necessary to provide a shelve system and a label LED strip lamp therefor which makes it possible to highlight the display side of the goods in the nearest row towards the client.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
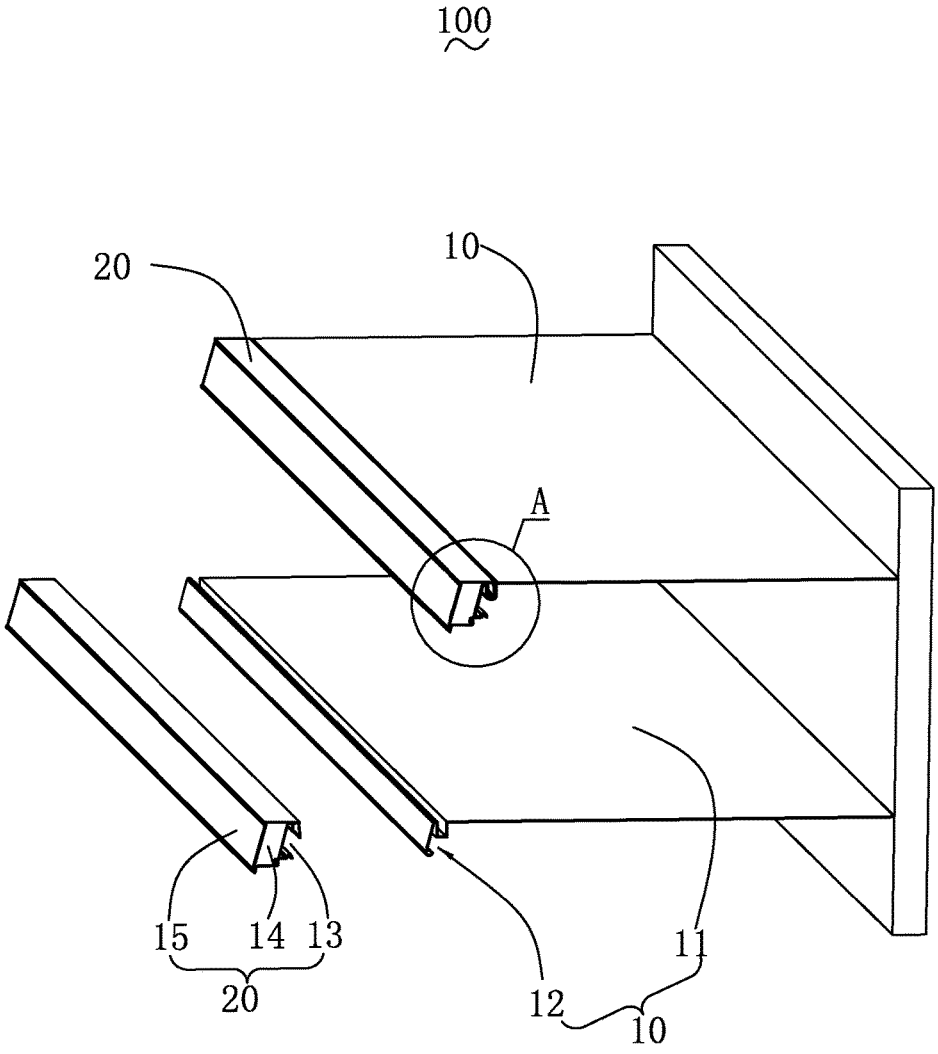
FIG. 1 is an explored view of a shelve system and a label LED strip lamp therefor according to an embodiment.
Figure 2:
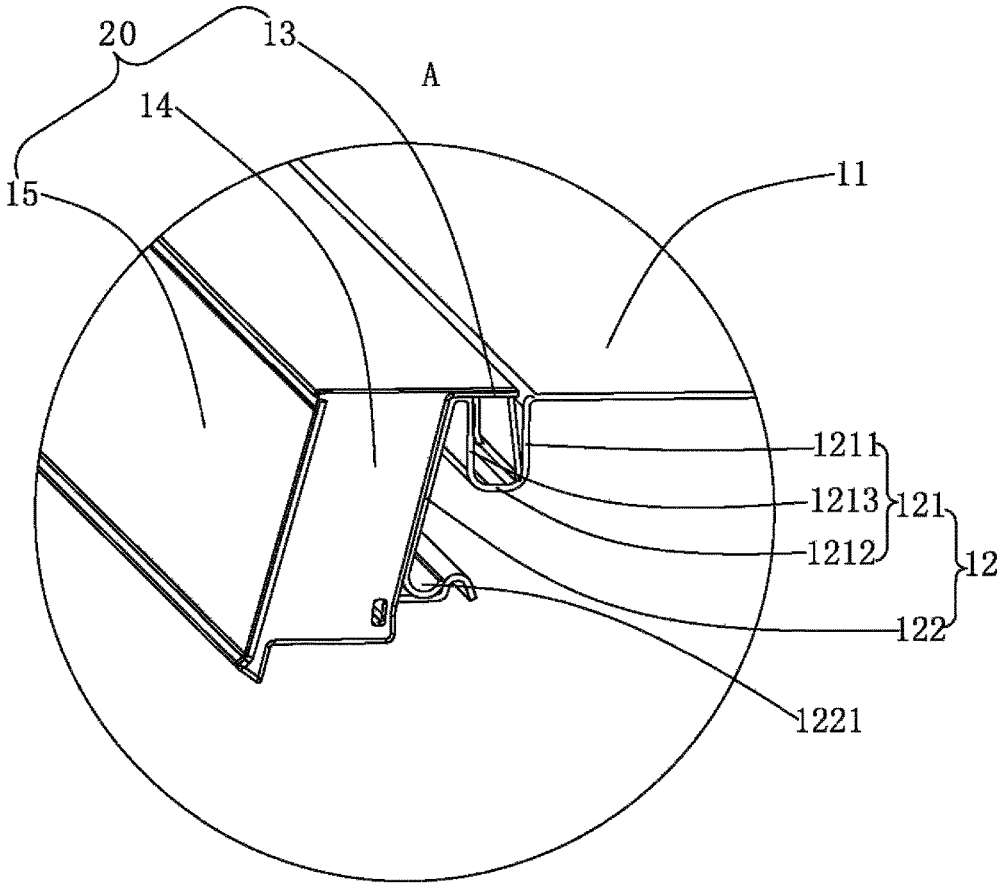
FIG. 2 is a partial enlarged view of the shelve system and the label LED strip lamp therefor of FIG. 1 at A.

Referring to FIG. 1 and FIG. 2, a shelve system 100 and a label LED strip lamp 20 therefor is shown. The shelve system 100 includes at least one carrier element 10. As is well known for a person in the art, the shelve system 100 generally includes a plurality of shelves rails, a lot of angle brackets, and many power supply plug device, etc., which are prior art and are not to be considered in the present invention, and are not described and illustrated in detail herein. The shelve system 100 generally includes a plurality of carrier elements 10. In the present embodiment, only one carrier element 10 is shown to illustrate the structure and operation principle of the label LED strip lamp 20. The carrier element 10 includes a body 11 and a clamping assembly 12 disposed on the body 11 and configured for assembling the label LED strip lamp 20. The body 11 is typically a flat plate for placing the goods or exhibits to be displayed and sold. The body 11 includes a free side toward the client. The free side faces the client and is configured for mounting a label. As is well known, the product label is used to indicate basic information of the goods, such as variety, price, bar code, origin, or the like. The label LED strip lamp 20 of the present invention can be used to replace the existing marking plate so as to not only serve the purpose of disposing the label but also highlight the display side of the goods in the nearest row towards the client.

The clamping assembly 12 includes a clamping slot 121 disposed on the body 11, and a catch plate 122 provided on the clamping slot 121. The clamping slot 121 includes a first wall 1211, a second wall 1212 interval with the first wall 1211, and a bottom portion 1213 connecting the first wall 1211 and the second wall 1212. Since the label is strip, the clamping slot 121 is also a bar-shaped groove. A free edge of the first wall 1211 is connected to the body 11 in the extending direction of the clamping slot 121, and a free edge of the second wall 1212 is connected to the catch plate 122. The spacing distance between the first and second walls 1211, 1212 may be set as desired, such as the strength of the clamping assembly 12 itself, and the need for clamping the label LED strip lamp 20. The catch plate 122 is used to mounting the label LED strip lamp 20. In order to facilitate the client to view the label, an angle between the second walls 1212 and the catch plate 122 is acute in an extending direction perpendicular to the clamping slot 121. In actual manufacturing, the clamping assembly 12 is stamped by a sheet material or the above-described components may also be connected by means such as welding. In order to facilitate access to the label LED strip lamp 20, the catch plate 122 includes a hook 1221 which provides at a free side thereof and acts to prevent the user from causing damage and facilitate to install the label LED strip lamp 20.

Figure 3:
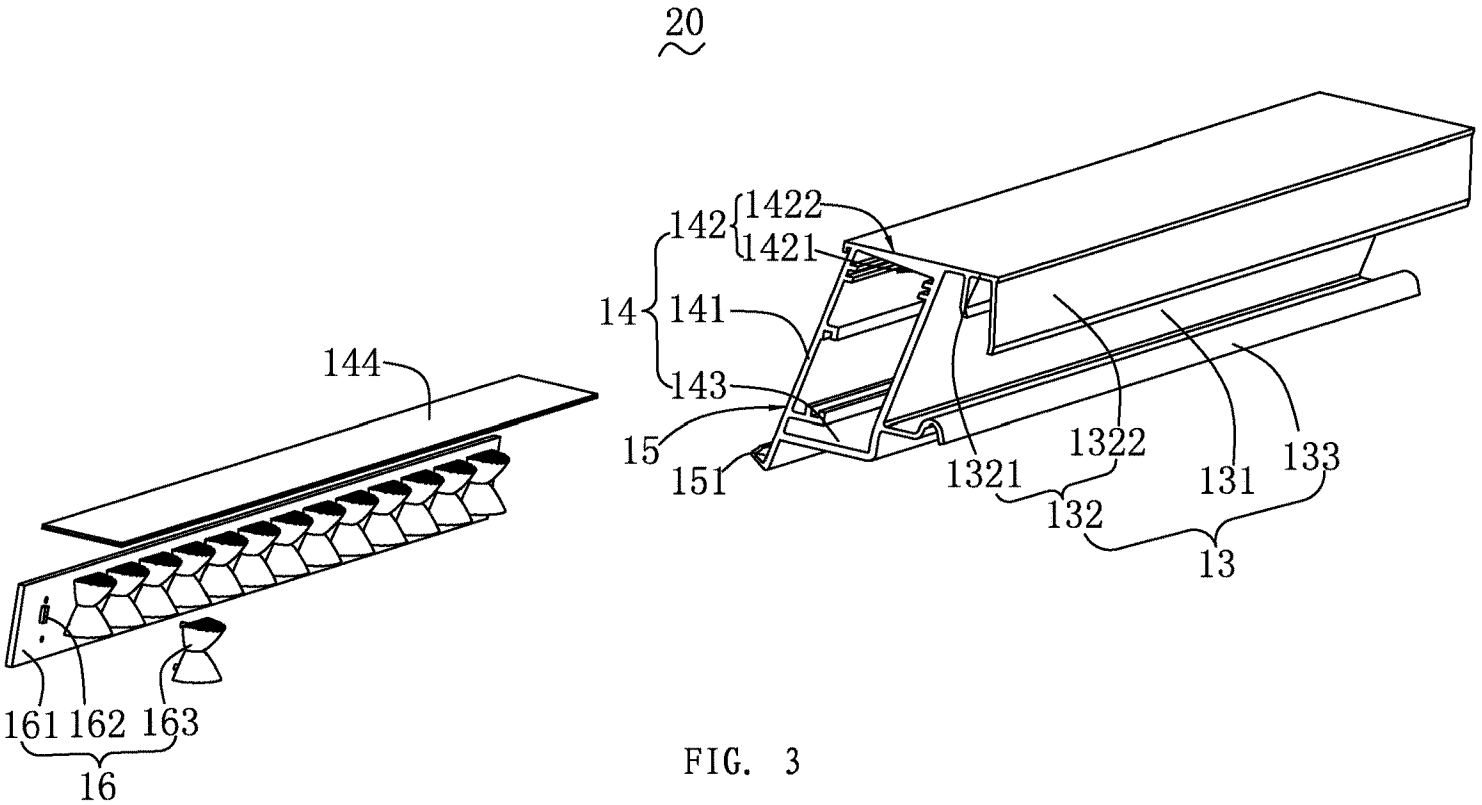
FIG. 3 is an explored view of the label LED strip lamp for the shelve system of FIG. 1.
Figure 4:
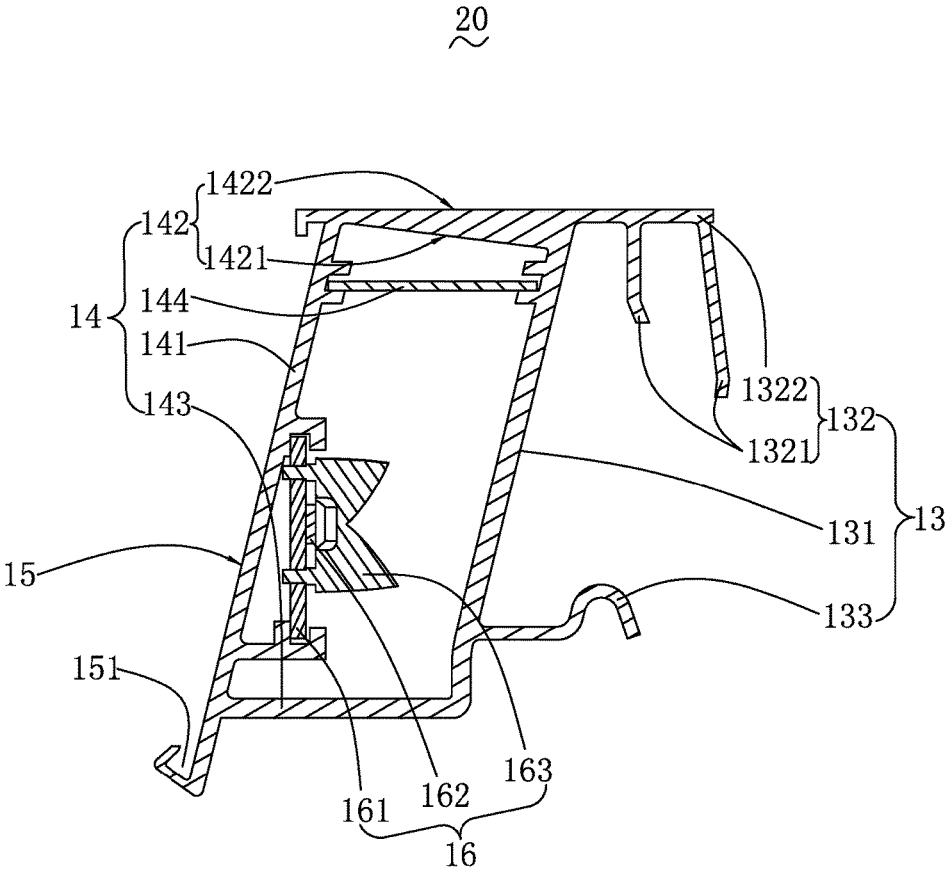
FIG. 4 is a sectional view of the label LED strip lamp for the shelve system of FIG. 3.

As shown in FIG. 3 and FIG. 4, the label LED strip lamp 20 includes a snap assembly 13 for engaging with the catch plate 122, a lamp tube 14 provided on the snap assembly 13, a label fixing assembly 15 disposed on the lamp tube 14, and a LED module 16 inserted in the lamp tube 14. The lamp tube 14 is located between the snap assembly 13 and the label fixing assembly 15. It is understood that the label LED strip lamp 20 also includes other functional modules, such as end caps, driver power sources, etc., which are not intended to be the subject of the present invention and will not be described in detail herein. In a cross section perpendicular to the extending direction of the clamping slot 121, the snap assembly 13 includes a connecting edge 131, a set of clamping tooth 132 disposed on one side of the connecting edge 131, and a wavy-shaped engaging edge 133 spaced from the clamping tooth 132. The snap assembly 13 may be extruded and integrally molded of plastic material. The connecting edge 131 is used for connecting the clamping booth 132, the wavy-shaped engaging edge 133, and the lamp tube 14. The connecting edge 131 may have same shape with the catch plate 122 so that the connecting edge 131 can be fitted into the catch plate 122. In the present embodiment, the catch plate 122 is a flat, so the connecting edge 131 is also a flat plate. When the catch plate 122 is wavy or bent, the connecting edge 131 may be formed in a wavy or bent shape accordingly. The clamping tooth 132 is configured for being inserted into the clamping slot 121 of the clamping assembly 12, which may have a hooked tooth extending from the connecting edge 131. In the present embodiment, the clamping tooth 132 include a tooth attachment edge 1321 extending from the connection edge 131 and at least one tooth 1322 disposed on the tooth attachment edge 1321. An angle between the tooth attachment edge 1321 and the connecting edge 131 is the sum of an angle between the catch plate 122 and the second wall 1212 and 90 degrees in an extending direction of the tooth attachment edge 1321 so that the tooth attachment edge 1321 may be parallel with the placement plane of the carrier element 10. In the present embodiment, the angle between the catch plate 122 and the second wall 1212 is less than 15 degrees. In the cross section perpendicular to the extending direction of the clamping direction 121, an angle between the extending direction of the tooth 1322 and the connection edge 131 is an acute which is larger than zero degree. And a thickness of the tooth 1322 is the same as a distance between the first wall 1211 and the second wall 1212. Or a minimum distance between the tooth 1322 and the connecting edge 131 is equivalent to a thickness between the second wall 1212 and the catch plate 122. As a result, when the tooth 1322 is snap into the clamping slot 121, the relative position between the tooth 1322 and the catch plate 122 can be fixed. In the present embodiment, the clamping tooth 132 includes two rows of teeth 1322 arranged side by side. An arrangement direction of the two rows of tooth 1322 is perpendicular to the extending direction of the clamping slot 121. And in a direction perpendicular to the extending direction of the clamping slot 121, a length of one of the teeth 1322 near the connecting edge 131 is smaller than that of the other which is remote from the connecting edge 131. The wavy-shaped engaging edge 133 is coupled to the hook 1221 of the catch plate 122. In the cross section perpendicular to the extending direction of the clamping slot 121, the extending direction of the wavy-shaped engaging edge 133 is parallel to the tooth attachment edge 1321. Moreover, in order to clamping the catch plate 122, a maximum distance between the wavy-shaped engaging edge 133 and the clamping tooth 132 is equal to a thickness of the catch plate 122. The snap assembly 13, the lamp tube 14, and the label fixing assembly 15 is integrally formed, the lamp tube 14 and the label fixing assembly 15 are injection molded by double-shot molding art.

Figure 5:
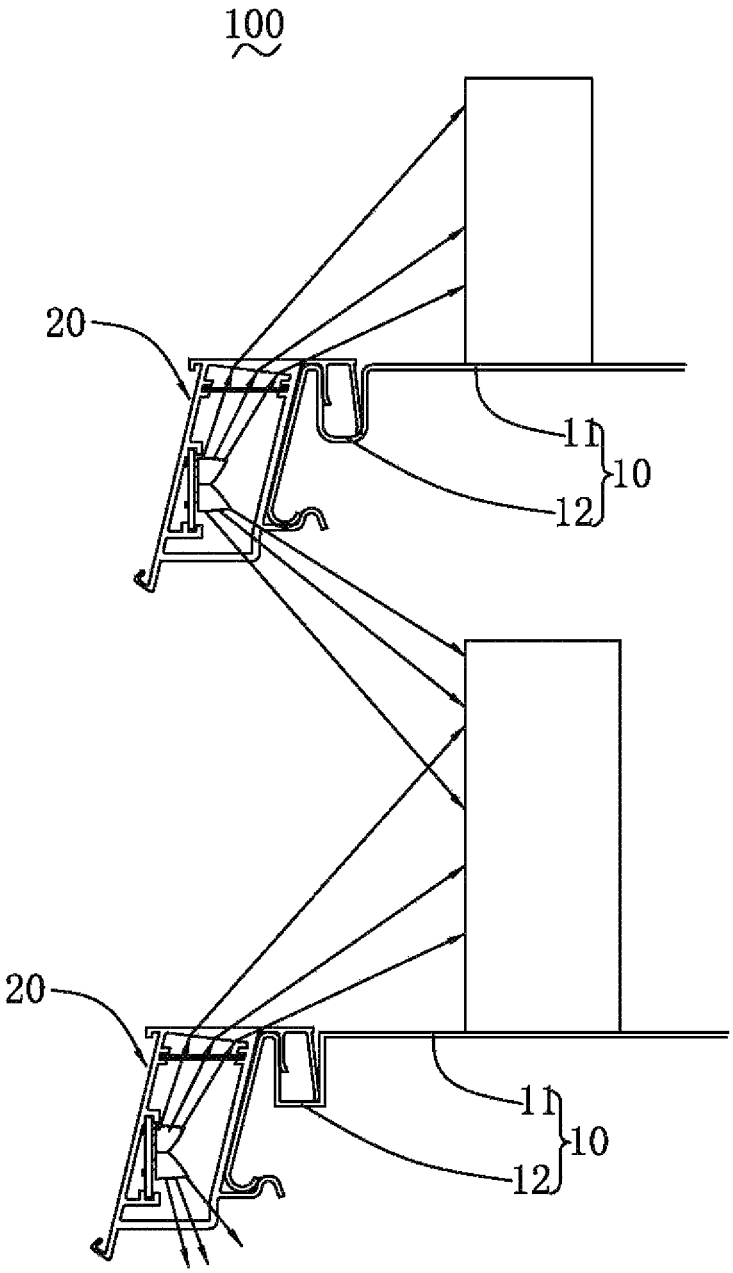
FIG. 5 is a light path view of the label LED strip lamp for the shelve system of FIG. 3 in the shelve system.

In the cross section perpendicular to the extending direction of the clamping slot 121, the connecting edge 131 of the snap assembly 13 is also a side wall of the lamp tube 14. The lamp tube 14 includes a non-transparent side 141, an upper light transmitting edge 142 connecting the non-transparent edge 141 and the connecting edge 131, and a lower light transmitting edge 143 connecting the non-transparent edge 141 and the connecting edge 131 and spaced apart from the upper light transmitting edge 142. The non-transparent edge 141 is used to set the label fixing assembly 15. Therefore, the non-transparent edge 141 is parallel to the connecting edge 131 in order to facilitate the client to view the label. A length of the non-transparent edge 141 is larger than that of the connecting edge 131. The upper light transmitting edge 142 includes an entrance side 1421 which faces the inner side of the lamp tube 14, and a light exit side 1422 which faces an outside of the lamp tube 14 in the cross section perpendicular to the extending direction of the clamping slot 124. That is to say, an angle between the entrance side 1421 and the carrier element 10 is less than 180 degrees and greater than 90 degrees so that the light reaching the entrance side 1421 of the upper light transmitting edge 142 towards the interior of the lamp tube 14 can be oriented in the direction of the carrier element 10. Referring to FIG. 5 again, when goods is placed onto the carrier elements 10, the emitted light of the upper light transmitting edge 142 can be irradiated on the display side of the goods to achieve the purpose of highlighting the display side of goods. A side of the upper light transmitting edge 142 towards the outside of the lamp tube 14 is a light exit side 1422. A angle between the light exit side 1422 and the carrier element 10 is 180 degrees such that the light exit side 1422 is parallel to the carrier element 10, which attribute to beautiful. And because the light exit side 1422 is parallel to the carrier element 10, the non-transparent side 141 is flush with a side of the connecting edge 131 on the upper light transmitting edge 142, and a side of the non-transparent side 141 near the lower light transmitting edge 143 is dislocated. Since the non-transparent side 141 and the connecting edge 131 are dislocated on the side of the lower light transmitting edge 143, the lower light transmitting edge 143 is not parallel to the carrier element 10. The lower light transmitting edge 143 may be an arc, an L-shaped structure, or a hypotenuse, which connected between a distal end of the non-transparent side 141 and the connecting edge 131. In the present embodiment, the lower transmitting edge 143 has a shape of L-shaped structure. Due to the presence of the lower light transmitting edge 143, the light can be emitted from the lower light transmitting edge 143 and irradiate onto the goods placed on the next carrier element 10 or illuminate the interior between the two carrier elements 10.

In the cross section perpendicular to the clamping slot 121, the non-transparent edge 141 of the lamp tube 14 is also one side of the label fixing assembly 15. The label fixing assembly 15 is made of non-transparent material and includes two slots 151. The two slots 151 are provided on the two sides of the non-transparent side 141 and spaced apart from each other. The two slots 151 are opened taken along the extending direction of the clamping slot 121. The label fixing assembly 15 may also be used to fix a label by other means.

The LED module 16 includes a circuit board 161 mounted onto the non-transparent edge 141 or the connecting edge 131, at least one LED chip 162 arranged on the circuit board 161, and at least one lens 163 disposed on light path of the LED chip 162. The circuit board 161 may be a printed circuit board (PCB) on which a circuit or other electronic component, such as a diode, a transistor, or the like, is provided to give the LED chip 162 a rated current or control signal. The LED chip 162 is a light-emitting diode known to those skilled in the art and will not be described again. The lens 163 may be a lens disclosed in Chinese patent Application No. 201320182509.3, entitled "a lens and a lighting system using the same". The lens 163 divides the outgoing light of the LED chip 162 into two kinds, and is emitted from the first and second exit surfaces (not shown) of the lens 163, respectively. The light emitted from the first and second exit surfaces is directed toward the upper light transmitting edge 142 and the lower light transmitting edge 143, respectively, and emitted from the upper and lower light transmitting edges 142 and 143, respectively. It can be understood that the LED module 16 may emit light from both sides thereof and may accomplish the above object.

The lamp tube 14 may also includes an optical diffusion film 144. The optical diffusion film 144 is located between the LED module 16 and the upper light transmitting edge 143. As a plurality of LED chips 162 is provided on the circuit board 162 in a granular manner, and the lenses 163 may also arranged one by one in the light path of each of the LED chips 162 so that the client may see a one-point light source from the upper light transmitting side 142, thereby affecting the photographic experience. In order to avoid such a situation, the optical diffusion film 144 is used to disperse the light directed toward the upper light transmitting side 142 so as to prevent from forming the effect of the point light source. The optical diffusion film 144 is a prior art, and its structure and working principle are not described in detail herein.

As described above, since the shelve system has the carrier element 10 and the label LED strip lamp 20, the light can be illuminated on the display side of the carrier element 10 towards the first row of the customer, also can be illuminated to the space under the carrier element 10 so that the client's shopping experience can be improved.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A shelve system and a label LED strip lamp therefor, comprising:

the shelve system comprising at least one carrier element, each of at least one carrier element comprising a body, and a clamping assembly disposed on the body and configured for assembling the label LED strip lamp;

the clamping assembly comprising a clamping slot disposed on the body, and a catch plate provided on the clamping slot;

the clamping slot comprising a first wall, and a second wall spaced from the first wall, in a cross section taken along an extending direction of the clamping slot, a free end of the first wall being connected to the body, a free end of the second wall being connected to the catch plate, and in the cross section perpendicular to the extending direction of the clamping slot an angle between the second wall and the catch plate being an acute angle;

the label LED strip lamp comprising a snap assembly for engagement with the catch plate, a lamp tube provided on the snap assembly, in the cross section perpendicular to the extending direction of the clamping slot;

the snap assembly comprising a connecting edge, a set of clamping tooth disposed on one side of the connecting edge, and a wavy-shaped engaging edge spaced apart from the clamping tooth, a maximum distance between the engaging edge and the clamping tooth being equal to a thickness of the catch plate, the clamping tooth being inserted into the clamping slot in the cross section perpendicular to the extending direction of the clamping slot;

the lamp tube comprising a non-transparent edge, an upper light transmitting edge connecting the non-transparent edge with the catch plate, and a lower light transmitting edge connecting the non-transparent edge with the catch plate, the upper light transmitting edge being spaced apart from the lower light transmitting edge, and the non-transparent edge having a larger width than the catch plate.

2. The shelve system and the label LED strip lamp as claimed in claim 1, wherein in the cross section perpendicular to the extending direction of the clamping slot, the upper light transmitting edge comprises an entrance side which faces an inner side of the lamp tube, and a light exit side which faces an outside of the lamp tube, an angle between the entrance side and the carrier element is less than 180 degrees and greater than 90 degrees, an angle between the light exit side and the carrier element is equal to 180 degrees.

3. The shelve system and the label LED strip lamp as claimed in claim 1, wherein the catch plate comprises a hook provided at a free side thereof, the hook is coupled to the wavy-shaped engaging edge.

4. The shelve system and the label LED strip lamp as claimed in claim 1, wherein in the cross section perpendicular to the extending direction of the clamping slot, the angle between the catch plate and the second wall is less than 15 degrees.

5. The shelve system and the label LED strip lamp as claimed in claim 1, wherein the connecting edge is parallel to the non-transparent edge in the cross section perpendicular to the extending direction of the clamping slot.

6. The shelve system and the label LED strip lamp as claimed in claim 1, wherein the label LED strip lamp further comprises a label fixing assembly disposed on the lamp tube, and a LED module mounted in the lamp tube, the lamp tube located between the snap assembly and the label fixing assembly.

7. The shelve system and the label LED strip lamp as claimed in claim 6, wherein the snap assembly, the lamp tube, and the label fixing assembly is integrally formed, the lamp tube and the label fixing assembly are injection molded by double-shot molding art.

8. The shelve system and the label LED strip lamp as claimed in claim 7, wherein the label fixing assembly is made of non-transparent material.

9. The shelve system and the label LED strip lamp as claimed in claim 7, wherein the lamp tube further comprises an optical diffusing film, the optical diffusing film is located between the LED module and the upper light transmitting edge.

10. The shelve system and the label LED strip lamp as claimed in claim 6, wherein the label fixing assembly comprises two slots, the two slots are provided on the two sides of the non-transparent edge and space apart from each other, the two slots are arranged along the extending direction of the clamping slot.

11. The shelve system and the label LED strip lamp as claimed in claim 1, wherein the clamping tooth comprises a tooth attachment edge extending from the connecting edge, and at least one tooth disposed on the tooth attachment edge, an angle between an extending direction of the tooth and tooth attachment edge is an acute, an angle between the tooth attachment edge and the connecting edge is equal to the sum of an angle between the catch plate and the second wall and 90 degrees in an extending direction of the tooth attachment edge.

12. The shelve system and the label LED strip lamp as claimed in claim 11, wherein the clamping tooth comprises two rows of teeth arranged side by side, an arrangement direction of the two rows of teeth is perpendicular to the extending direction of the clamping slot, a length of the tooth near the catch plate is less than that of the tooth which is remote from the catch plate.

* * * * *